US008572934B2

(12) United States Patent
Jay

(10) Patent No.: US 8,572,934 B2
(45) Date of Patent: Nov. 5, 2013

(54) FOOD PORTIONING SYSTEM

(76) Inventor: Jeffrey Jay, Three Rivers, CA (US)

( * ) Notice: Subject to any disclaimer, the term of this patent is extended or adjusted under 35 U.S.C. 154(b) by 213 days.

(21) Appl. No.: 13/098,974

(22) Filed: May 2, 2011

(65) Prior Publication Data

US 2011/0268854 A1 Nov. 3, 2011

Related U.S. Application Data

(60) Provisional application No. 61/330,585, filed on May 3, 2010.

(51) Int. Cl.
*B65B 1/24* (2006.01)

(52) U.S. Cl.
USPC ..... 53/526; 53/436; 53/509; 53/523; 53/528; 53/122

(58) Field of Classification Search
USPC ..... 53/436, 441, 509, 111 R, 113, 121–122, 53/523, 526, 528
See application file for complete search history.

(56) References Cited

U.S. PATENT DOCUMENTS

| | | | | |
|---|---|---|---|---|
| 4,045,584 | A * | 8/1977 | Jones et al. | 426/289 |
| 4,684,025 | A * | 8/1987 | Copland et al. | 206/484 |
| 4,835,942 | A * | 6/1989 | Skrmetta | 53/453 |
| 5,408,804 | A * | 4/1995 | Schroder | 53/452 |
| 5,619,844 | A | 4/1997 | Meli et al. | |
| 5,980,228 | A | 11/1999 | Soper | |
| 8,181,433 | B2 * | 5/2012 | Kring, Jr. | 53/469 |
| 2005/0123663 | A1 * | 6/2005 | White et al. | 426/518 |
| 2005/0170053 | A1 * | 8/2005 | Milani et al. | 426/414 |
| 2008/0268116 | A1 * | 10/2008 | Kring | 426/411 |

* cited by examiner

*Primary Examiner* — Christopher Harmon
(74) *Attorney, Agent, or Firm* — Andrus, Sceales, Starke & Sawall, LLP

(57) ABSTRACT

A system for providing single portion viscous or semi-viscous food products utilizes an indexing conveyor to serially dispense pieces of top packaging material thereon, deliver a precise volume of the single serve food product, deposit a top packaging material piece thereon, press the sandwiched layer together to form the final shape of the food product and, optionally, heat seal the top and bottom material pieces to enclose the food product. Optional system layouts include cooling and/or oxygen depleted zones and multiple lane operation and serially adjacent rows of system components wherein the indexing conveyor moves forward by two increments at each indexing cycle.

4 Claims, 6 Drawing Sheets

Cut retract
Vacuum on

Filmcut
Vacuum on

Film index in
Vacuum off

Film deposited
Vacuum off

FOOD PORTIONING SYSTEM

CROSS REFERENCE TO RELATED APPLICATION

This application relates to and claims priority from U.S. Provisional Application Ser. No. 61/330,585 filed on May 3, 2010.

BACKGROUND OF THE INVENTION

The disclosure in this application relates to a food portioning apparatus and method and, more particularly, to a system and method for producing single serve portions of viscous semi-liquid or semi-solid food products in various shapes.

SUMMARY OF THE INVENTION

In bagel restaurants, cream cheese is either added to the bagel by scooping from bulk containers or the customer is given a single self-serve portion packaged in a small foil wrapped block or in a plastic tub with a foil lid. In the former case, portion control is dependent on the skill of the store personnel. The present invention provides for the production of film or foil wrapped single-serve portions of cream cheese or other food products that are shaped to fit the bagel, with or without a central hole. The single serve portion is applied to the bagel by peeling the film from one side, applying the peeled side to the cut surface of the bagel and removing the remaining film or foil leaving the cream cheese in place on the bagel. This provides accurate portion control and convenience to both store personnel and customers. The technique can be used for other dairy products, such as soft goat cheese.

Fast food restaurants place square or rectangular processed cheese slivers on top of hamburgers and breakfast sandwiches. This cheese often partially melts and due to its format, the corners protrude and then droop down the sides of the sandwich. This partially melted cheese often sticks to the paper wrapping and separate from the sandwich. The invention provides for the production of processed cheese slices that fit the hamburger or breakfast sandwich without any corners protruding, thus eliminating the loss of cheese on the wrapper. The fast food restaurant could realize a saving of between 10% and 20%, depending on whether they want a small overlap that will droop over the meat and/or egg filling within the confines of the bun, muffin or bagel.

Product can be packaged at high temperature to reduce chances of bacterial contamination. The system can product products of different types, shapes, sizes and thicknesses that can be changed rapidly. Product shape is determined by the design of the product dispensing head. A wide variety of food-safe packaging materials can be used, including, but not limited to parchment paper, plastic film, aluminum foil and multi-layer composite materials. Product can be chilled or flash frozen within the packaging machine. Product can be packed in a modified atmosphere to retard the growth of spoilage organisms.

DETAILED DESCRIPTION OF THE PREFERRED EMBODIMENTS

Figure 1:
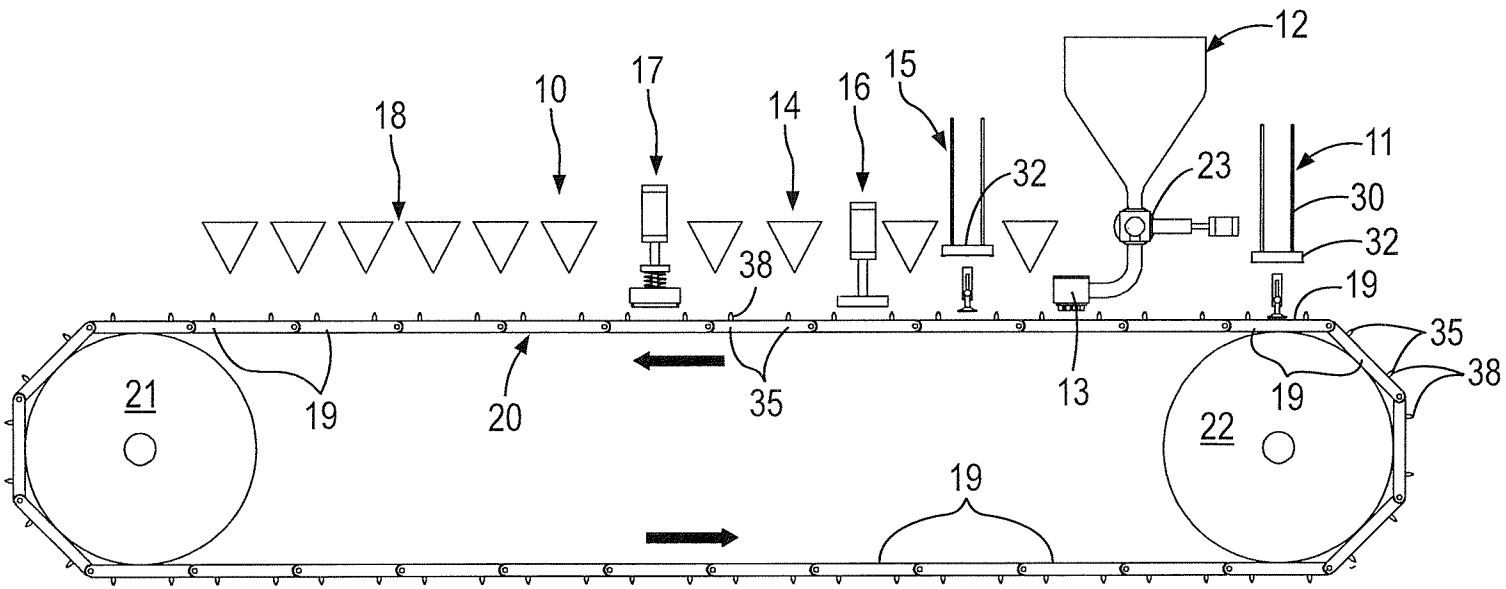
FIG. 1 is a side elevation view of one embodiment of the system of the subject invention.

One embodiment of a food portioning system 10 comprises the following main components: bottom packaging material dispensing and positioning device 11 (FIGS. 1, 3 and 3A-3C); product feed hopper 12 with optional heating jacket and agitator (FIGS. 1, 4A and 4B); product dispensing head 13 (FIGS. 1, and 4A-4C); optional modified atmosphere packaging zone 14 (FIG. 1); top packaging material dispensing and positioning device 15 (FIGS. 1, 3 and 3A-3C); product forming press 16 (FIGS. 1, 5A and 5B); optional heat sealing device 17 (FIG. 1); optional product cooling zone 18 (FIG. 1); main indexing conveyor 20 (FIG. 1); main conveyor drive sprocket 21 (FIG. 1); main conveyor idler sprocket 22 (FIG. 1).

Principle of operation: flowable, viscous or semi-viscous food product is loaded in to the feed hopper 12. Optionally solid meltable material can be added to the feed hopper. Solid material can be melted by means of an optional heating jacket and agitator fitted to the feed hopper 12.

Figure 4B:
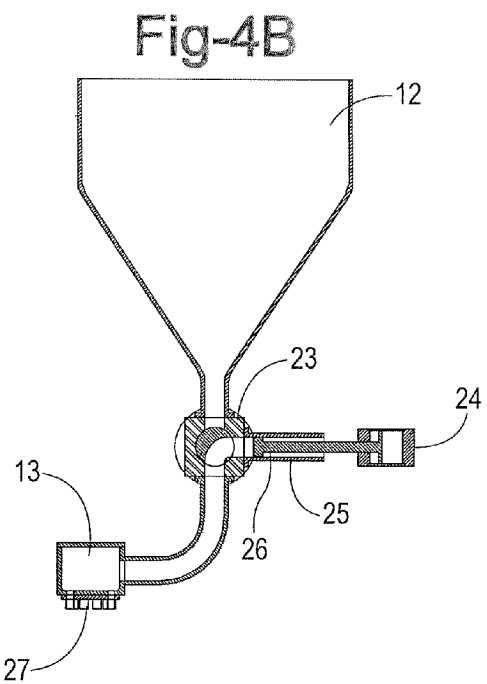
FIGS. 4A, 4B and 4C are views of the food product dispensing head and supply hopper of the present invention.
Figure 4A:
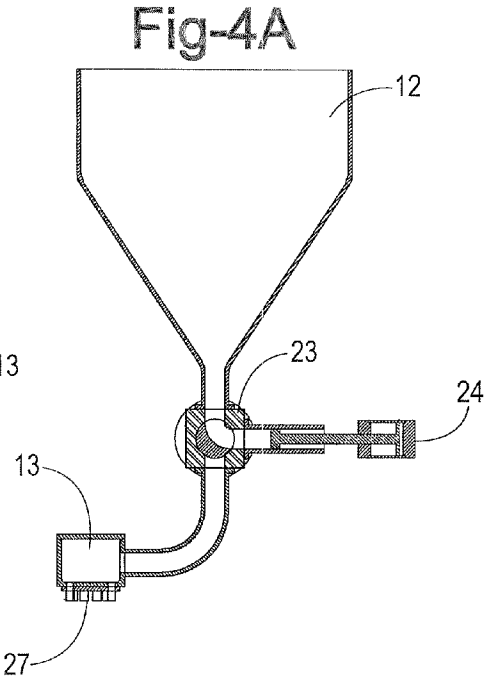

Prior to normal operation, the food dispensing head 13 is primed to ensure that all air is purged from it. Priming takes place as follows. See FIGS. 4A and 4B. A rotary valve 23 is rotated by actuator 24 (FIGS. 4A and 4B) to a position that enables passage of material from the hopper 12 to a product suction chamber 25 as illustrated in FIG. 4A. Actuator 24 may be pneumatically, electrically or mechanically operated. Piston 26 is partially withdrawn from the product suction chamber 25 by means of actuator 24. This creates a negative pressure inducing product to flow from the hopper 12 into the product suction chamber. The rotary valve 23 is rotated by actuator 24 to a position that enables passage of material from the product suction chamber to the food dispensing head 13 as illustrated in FIG. 4B. Piston 26 pushes the product from the product suction chamber 25 to the food dispensing head 13 by means of actuator 24 working in reverse direction. These steps are repeated until a smooth flow of food product is observed emerging from the food dispense head nozzles 27.

Figures 3, 3A, 3B, 3C:
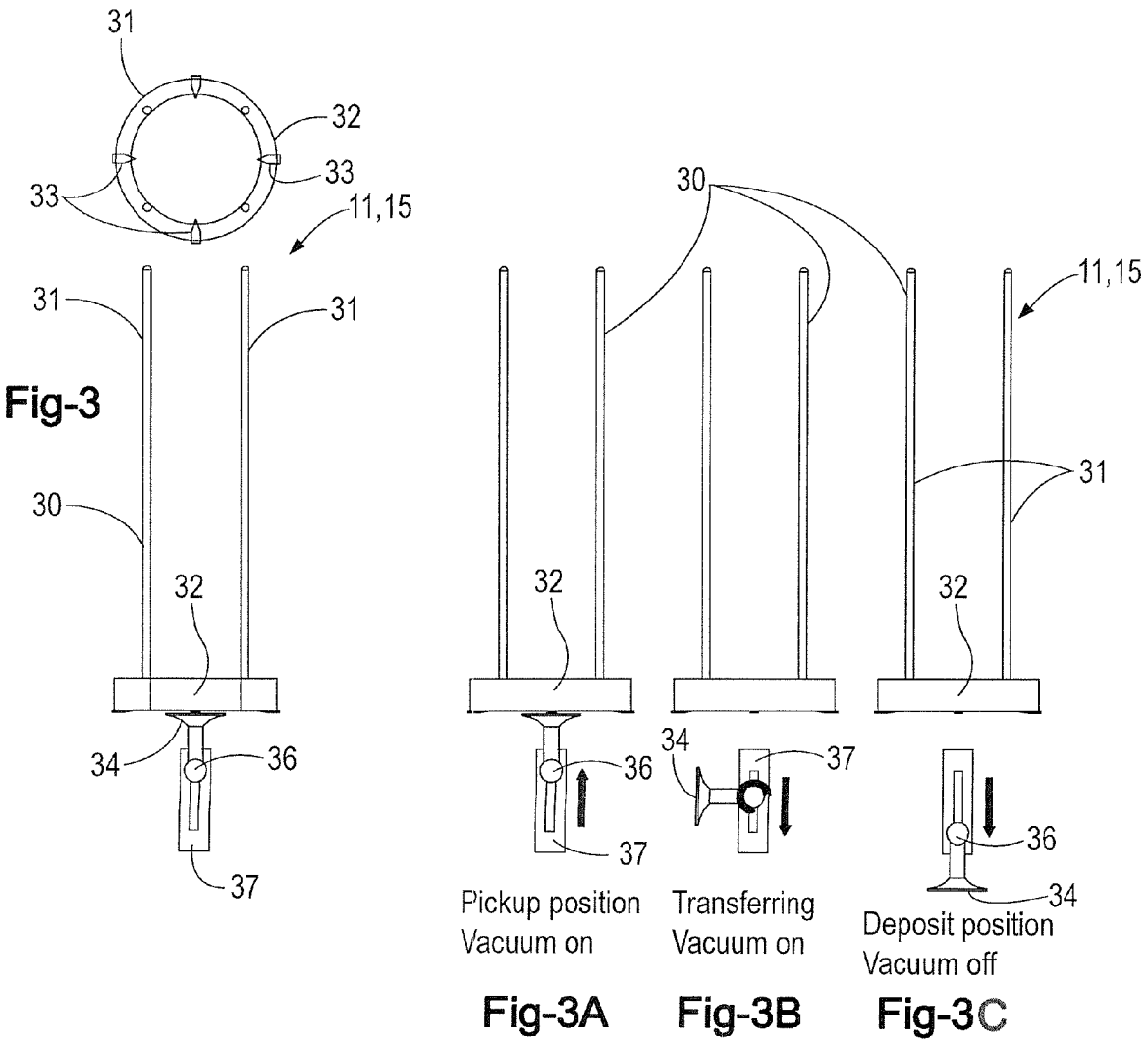
FIGS. 3, 3A, 3B and 3C comprise a composite elevation view of the packaging material dispensing device of the FIG. 1 embodiment.
Figure 4C:
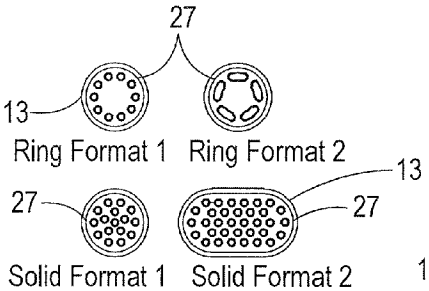
Figure 4D:
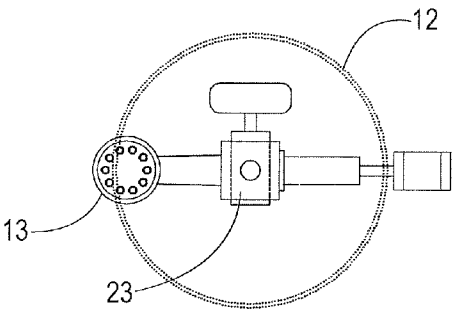

The system is now ready to operate normally as follows. Pre-cut pieces of packaging material 28 are loaded into the magazine 30 of the bottom packaging material dispensing device 11 that comprises multiple support columns 31 (FIGS. 3 and 3A-3C) and support ring 32 (FIG. 3). Packaging material 28 is supported on small structures 33 that protrude around the periphery of and support the material. Individual pieces of packaging material 28 are picked from the bottom of the bottom packaging material dispensing device 11 (FIG. 3A) by means of a vacuum cup 34 or series of cups and deposited within locating devices 35 (FIG. 1) on the indexing conveyor 20 by means of pivot 36 (FIGS. 3A-3C) and vertical actuator 37 as illustrated in FIGS. 3A-3C. Accurate registration of the deposited film is achieved by means of precise indexing of the indexing conveyor 20 via indexing drive sprocket 21 and its follower 22 and by means of the film locating devices 35. The film locating device typically comprises four or more tapered pins 38 set into the conveyor 20 and which act as guides for the bottom packaging material 28 as it is released from the vacuum cups 34. The conveyor 20 indexes forward to bring the bottom film piece 28 into position under the food dispensing head 13 (FIGS. 1 and 4A). Piston 26 (FIG. 4B) pushes the product from the product suction chamber 25 to the food dispensing head 13 by means of actuator 24 (FIG. 4B) working in reverse direction. This deposits a pre-measured quantity of food product 29 onto the bottom film piece 28 in a pattern determined by the discharge orifices of the dispensing head 13. These may be arranged to form a solid shape or a shape with a void or voids in the final shaped mass. FIG. 4C illustrates some typical orifice arrangements. Although pre-measurement of dispensed quantity is typically achieved by the precise volumetric displacement of product 29 by means of a piston 26, as described, it may also be achieved by means of an alternative pumping system or extruder.

Figure 5B:
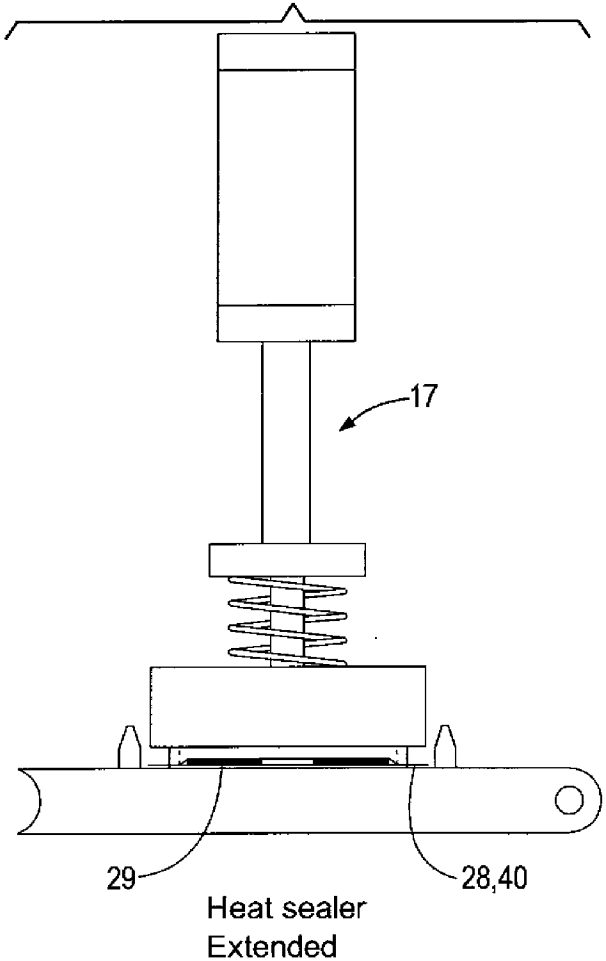
FIGS. 5A and 5B are elevation views of the heat sealing device of the disclosed system showing the edge sealing head in its inoperative and operative positions.
Figure 5A:
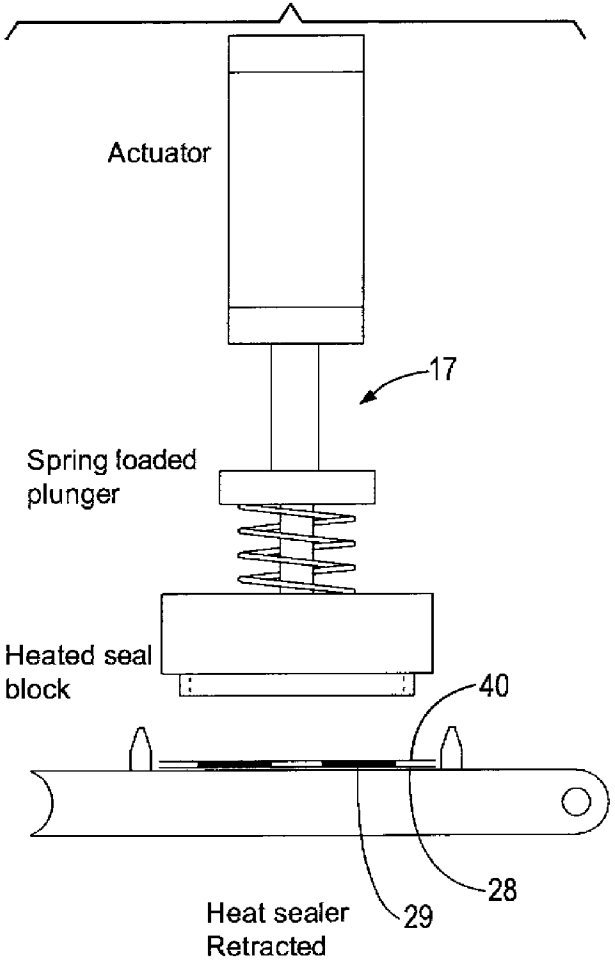
Figure 6C:
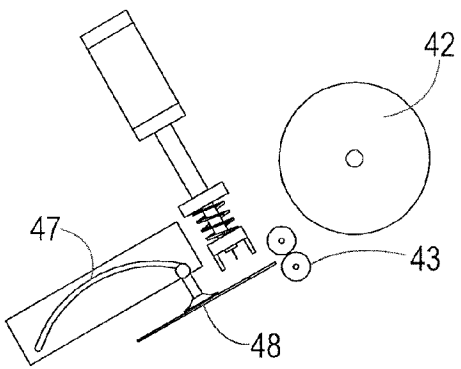
FIGS. 6A-6D are side elevations showing the sequence of operation of a bottom and top material dispensing and positioning device supplied by packaging material roll stock.
Figure 6B:
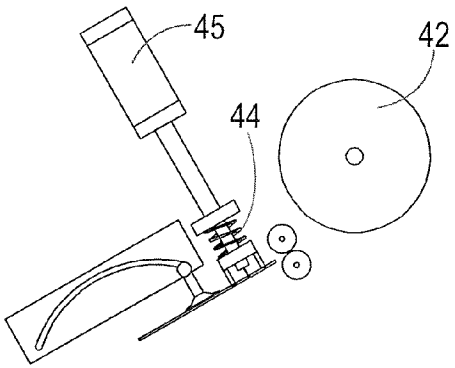
Figure 6A:
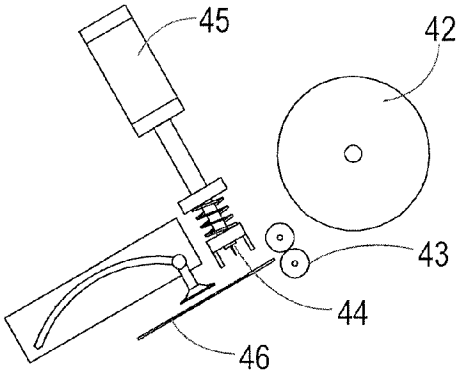
Figure 6D:
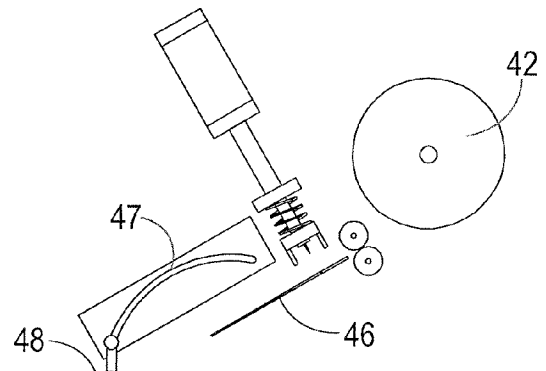

The conveyor 20 (FIG. 1) is indexed forward to bring the bottom film piece 28 with its charge of product 29 under the top packaging material dispensing and positioning device 15 (FIG. 1). Pre-cut pieces of top packaging material 40 are picked from the base of the top packaging material dispensing device 15 (FIG. 1) by means of vacuum cups 34 or other device and deposited on top of the dispensed food product 29. This device is similar in operation to the bottom packaging material dispenser 11 (FIG. 1). The conveyor 20 indexes forward to bring the bottom packaging material 28, food product 29 and top packaging material 40 under the product forming press 16 (FIG. 1). The product forming press extends to a fixed level above the surface of the conveyor 20, squeezing the food product 29 into a layer sandwiched between the top 40 and bottom 28 packaging material. This forms a shape that was determined by the arrangement of the orifices (FIG. 4C) on the food dispensing head 13 (FIG. 1). The conveyor 20 indexes forward to position the food product and its packaging material immediately under the optional heat sealing device 17 (FIGS. 1, 5A and 5B). This device can seal heat sensitive packaging material to totally enclose the food product 29. For continuous cycling, all devices function as above after every conveyor indexing cycle giving true continuous operation. If required, a modified atmosphere zone 14 (FIG. 1) can be applied between the food dispensing head 13 and the optional heat sealing device 17. This is typically an oxygen depleted gas mixture that reduces product spoilage due to the growth of aerobic bacteria, yeasts and molds. After either heat sealing or product forming, the food product can be cooled or frozen by means of cold air or gas in the product cooling zone 18.

It is also possible to incorporate an edge heat seal device, similar to optional heat sealing device 17, into the product forming press 16. In this manner, two processing steps, forming and heat sealing, may be carried out with a single device.

Multiple systems 10 (FIG. 1) can be positioned longitudinally across the width of the indexing conveyor 20 to achieve multiple lane operation. Systems comprising multiple rows of devices can be mounted transversely in index registration across the width of the indexing conveyor 20, making it possible to increase the capacity of the system without exceeding practical width constraints. For example, where rows of two of each device are installed, the indexing conveyor 20 will move forward by two increments at every indexing cycle.

Figure 2:
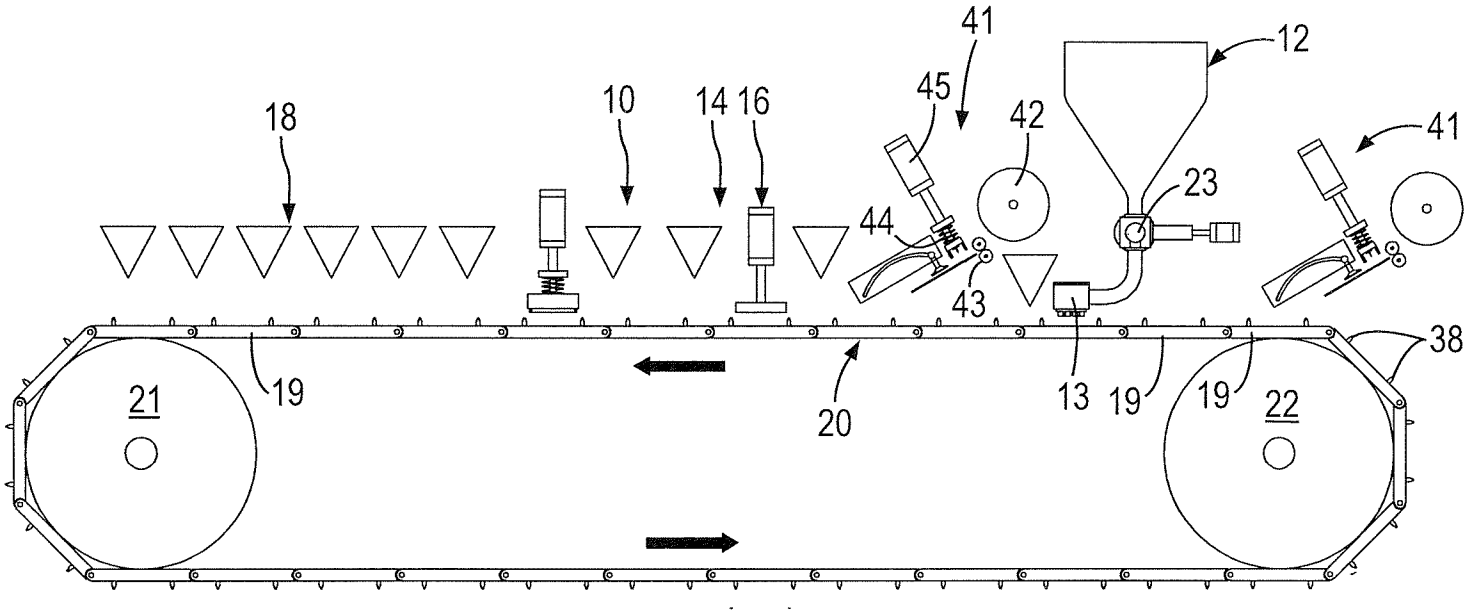
FIG. 2 is a side elevation of another embodiment utilizing different bottom and top packaging material dispensing and positioning devices.

In another embodiment, packaging material dispensers 11 and 15 are replaced by on-machine cutter-dispensers 41 fed from roll-stock material 42 (FIGS. 2 and 6). Cutter-dispenser 41 includes, as shown in FIG. 6: roll-stock film or other packaging material 41; drive rollers 43; cutter with clamping device 44; cutter actuator 45; support plate 46; transfer mechanism 47; and, suction cup 48 or cups.

Drive rollers 43 index a fixed amount of packaging material 42 onto the support plate 46. Suction cup 48 or cups hold the packing material in place while cutter and clamping device 44 cuts the film piece 50 from the roll 42. The clamping device 44 holds the film piece in place while it is cut. Cutting and clamping is achieved by means of the cutter actuator 45. The cutting and clamping device (FIG. 6) is withdrawn and is retracked by means of the cutter actuator 45. The cut packaging material piece is transported and rotated to a vertical downward orientation by means of the transfer mechanism track 47 and vacuum cup 48 or cups. The packaging material piece 50 is deposited between the locating devices 35 (FIGS. 1 and 6D) on the indexing conveyor 20 by means of releasing the vacuum on vacuum cup 48 or cups.

What is claimed is:

1. An apparatus for producing packaged single serve portions of extrudable semi-liquid or semi-solid food products of various shapes and thicknesses, comprising:

an indexing conveyor having a generally horizontal conveying surface operating wider the control of a downstream indexing drive;

a bottom packaging material dispensing and positioning device operative to place cut pieces of bottom packaging material on upstream indexed surface portions of the conveyor;

a food product dispensing head operative to deposit pre-measured quantities of a food product onto the bottom pieces of packaging material indexed to a position beneath the dispensing head;

a top packaging material dispensing and positioning device operative to place cut pieces of top packaging material onto the food products indexed to a position beneath the top packaging material dispensing and positioning device;

a product forming press operative to press the food product into layers between the bottom and top cut pieces of packaging material indexed to a position beneath the product forming press; and at least one of the packaging material dispensing devices is fed from packaging material roll stock and comprises:

a support plate receiving, a measured end portion of a web of material from a roll, the web having a width equal to the width of the material piece;

a clamping cutter operative to cut the web on the support plate to the length of the material piece; and a material piece transfer device operative to move the cut piece of material from the support plate and place the piece on one of the surface portion of the conveyor and the dispensed food product.

2. The apparatus as set forth in claim 1 including a pair of length controlled nip rolls operative to move the end portion of the web onto the support plate.

3. The apparatus as set forth in claim 1 wherein the clamping cutter includes a linear actuator operative to move the cutter from a non-contact position to a cutting position in contact with the support plate.

4. The apparatus as set forth in claim 1 wherein the material piece transfer device comprises a suction device mounted for travel along a track between a piece pick-up position over the support plate and a dispense position on one of said surface support portion and said food product.

* * * * *